United States Patent [19]

Herman et al.

[11] 4,216,652

[45] Aug. 12, 1980

[54] INTEGRATED, REPLACEABLE COMBUSTOR SWIRLER AND FUEL INJECTOR

[75] Inventors: Avrum S. Herman; Samuel B. Reider, both of Indianapolis; Cecil H. Sharpe, Brownsburg, all of Ind.

[73] Assignee: General Motors Corporation, Detroit, Mich.

[21] Appl. No.: 913,818

[22] Filed: Jun. 8, 1978

[51] Int. Cl.[2] ..... B05B 7/10

[52] U.S. Cl. ..... 60/748; 239/400; 239/406

[58] Field of Search ..... 60/39.74 R, 39.74 B; 239/400, 403, 404, 405, 406

[56] References Cited

U.S. PATENT DOCUMENTS

| | | | |
|---|---|---|---|
| 3,403,510 | 10/1968 | Lauck | 60/39.74 R |
| 3,703,259 | 11/1972 | Sturgess | 60/39.74 R |
| 3,853,273 | 12/1974 | Bahr | 60/39.74 R |
| 4,111,369 | 9/1978 | Sharpe | 239/400 |

*Primary Examiner*—Douglas Hart
*Attorney, Agent, or Firm*—J. C. Evans

[57] ABSTRACT

An air blast fuel supply system for a gas turbine engine comprises a floating swirler separated from the fuel injector and means for radially supporting both the swirler and fuel injector for free radial movement with respect to a combustor dome; a fuel atomization lip on the floating swirler is located in spaced overlying relationship to a tangential fuel director to form an annular fuel film at the outlet of the fuel injector and an outer annular air flow directing lip on the floating swirler directs inlet air flow against the fuel film as it leaves the atomization lip. The fuel injector includes a nozzle tube that slips to permit free axial movement of said fuel injector with resepct to the dome and wherein the tangential fuel director maintains the annular fuel film throughout axially shifted positions of said nozzle tube. This allows the fuel nozzle to be inserted through a small opening in the engine case while maintaining the integrated relationship with the swirler attached to the combustor. The fuel atomization lip has an outlet edge thereon and an outer annular air flow directing lip has outlet edge thereon maintained at a constantly fixed dimensional relationship therebetween throughout axial shifted positions of the nozzle tube whereby the fuel break-up point for atomization of fuel and air remains the same with respect to the combustor during engine operation.

2 Claims, 3 Drawing Figures

INTEGRATED, REPLACEABLE COMBUSTOR SWIRLER AND FUEL INJECTOR

The invention described herein was made in the course of work under a contract or subcontract thereunder with the Department of Defense.

This invention relates to gas turbine engine fuel supply nozzles and more particularly to such apparatus which are removably supported on domed ends of gas turbine engine combustion apparatus.

Canister type combustion apparatus and flame tube constructions typically include a dome mounted axially directed air-fuel nozzle assembly connected together to provide an air-fuel mixture within the combustor with resultant complete combustion of air and fuel components.

The concept of integrating a nozzle swirler with a spray tube and supply strut which is mounted on the outer case of a gas turbine engine is set forth in U.S. Pat. No. 3,589,127 issued June 1971, to Kenworthy et al. In this arrangement, a fuel spray tube is piloted into a dome mounted floating swirler. However, the arrangement does not account for axially directed thermal expansion between component parts of the nozzle tube and the mixing area for air and fuel within a perforated dome on a gas turbine engine. Rather, the arrangement produces pressure atomization and spray of fuel into a prechamber. Air mixing with the fuel occurs after the fuel injection and the point of air and fuel mixing may vary in accordance with changes in the operating temperature of the gas turbine engine combustor.

Another arrangement for directing air and fuel into a gas turbine engine is set forth in U.S. Pat. No. 3,703,259, issued November, 1972, to Sturgess et al, which shows a fuel nozzle with a floating air blast swirler including a pilot nozzle and main fuel injection fuel ports therein. The arrangement further includes dual shrouds that contain the air-fuel mixture. In this arrangement, as in other prior art arrangements, the nozzle is free to move axially and change the point of the mixture between fuel being directed from the nozzle and air-fuel relative to the nozzle. As a result, there can be differences in the atomization of the air-fuel mixture during gas turbine engine operation.

Accordingly, an object of the present invention is to provide an improved air-fuel supply for a gas turbine engine combustor wherein there is a relative movement between fuel support ports in a fuel nozzle and adjacent dome mounted swirler components by the provision of means within an air blast fuel supply system to maintain a constantly fixed dimensional relationship between an annular film of main fuel flow and an air directing shroud whereby a fuel break-up point and atomization of fuel and air remains the same within the combustor during all phases of gas turbine engine operation and during changes in the operating temperature of the combustor components.

Still another object of the present invention is to provide an improved air blast fuel supply system for a gas turbine engine which is removably supported on a domed end of a canister type gas turbine combustor including a floating swirler and a separately formed fuel injector means and further including means thereon that will produce a constantly fixed dimensional relationship between an annular film of main fuel flow and atomization air from the swirler whereby the fuel breakup point for atomization of the fuel film and air blast remains the same during all phases of temperature change in the combustor apparatus and does so while maintaining full air flow patterns through the swirler.

Yet another object of the present invention is to provide an improved air blast fuel supply system for gas turbine engine including a floating swirler and fuel injector and associated means for radially supporting both the swirler and fuel injector for unrestrained radial movement with respect to a combustor dome and wherein the floating swirler includes a fuel atomization lip located in spaced overlying relationship to a tangential fuel director and operative to form an annular film of fuel flow at the outlet of the fuel injector and wherein an outer annular air flow directing lip on the floating swirler directs inlet air flow against the fuel line as it leaves the atomization lip and wherein the nozzle tube is arranged to slip to permit free axial movement of the fuel injector with respect to the dome while the tangential fuel director and fuel atomization lip maintain the annular fuel film at the same exit point with respect to the dome throughout the axially shifted position of the nozzle tube so that the air blast thereagainst will be fixed at a constantly held dimensional relationship so as to produce a fuel breakup point and consequent atomization of fuel and air flow that remains the same during all phases of fuel flow into the combustor apparatus.

Further objects and advantages of the present invention will be apparent from the following description, reference being had to the accompanying drawings wherein a preferred embodiment of the present invention is clearly shown.

Figure 1:
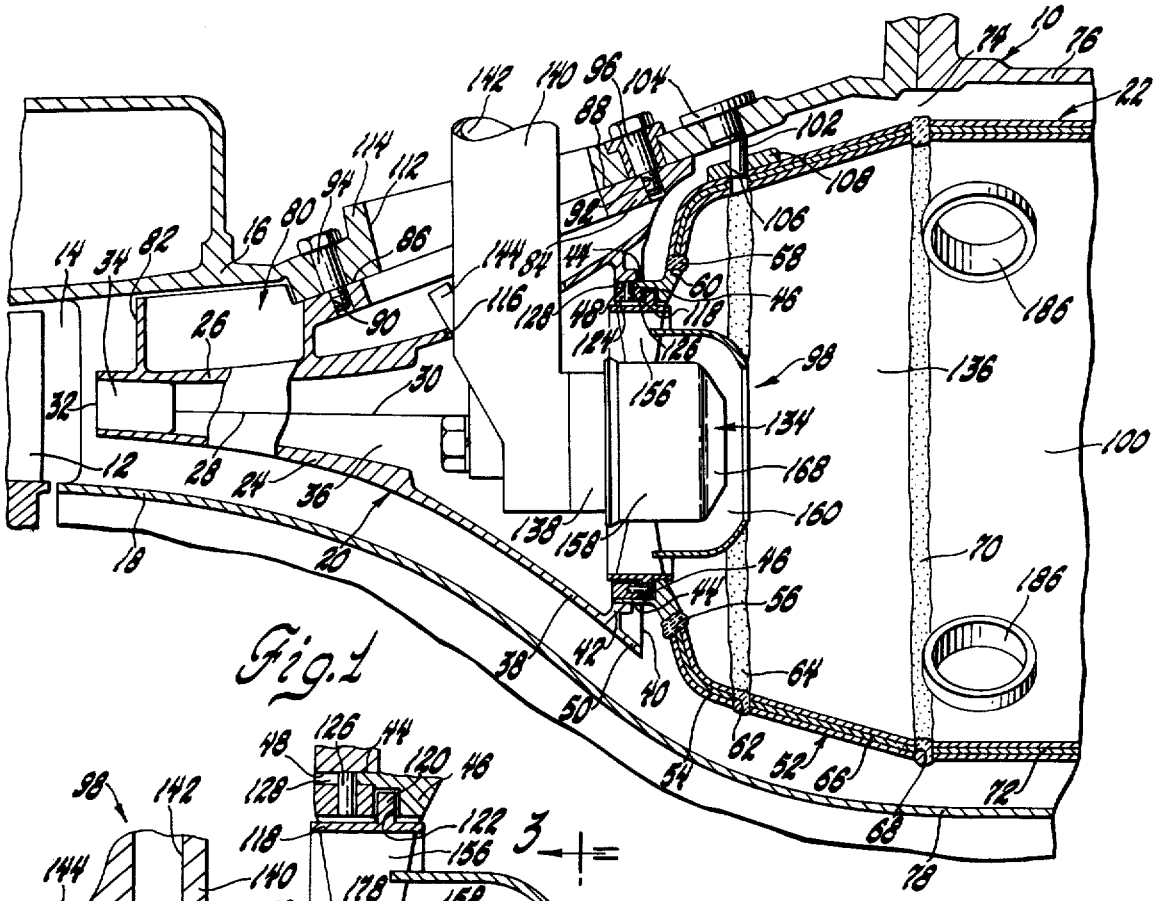
FIG. 1 is a fragmentary, longitudinal sectional view of gas turbine engine combustion apparatus including the air/fuel supply system of the present invention.

Referring now to the drawings, FIG. 1 has illustrated schematically therein, a portion of a gas turbine engine 10 including a compressor 12 of the axial flow type in communication with a discharge duct 14 defined by a first radially outer annular engine wall 16 and a second radially inwardly located annular engine wall 18.

An inlet diffuser member 20 is located downstream of the discharge duct 14 to distribute compressed air from the compressor 12 to a canister type combustor assembly 22 constructed in accordance with the present invention.

More particularly, in the illustrated arrangement, the inlet diffuser member 20 includes a contoured lower plate 24 and a contoured upper plate 26 joined at their side edges by longitudinal seam welds 28, 30, respectively.

The plates 24, 26 together define a low profile inlet opening 32 located approximately at the midpoint of the duct 14. A flow divider plate 34 is located between the inlet ends of the plates 24, 26 to uniformly distribute compressed air flow into a radially divergent flow passage 36 formed between the lower and upper plates 24, 26, respectively, which are contoured to define a radially outwardly flared cone 38 at the outlet end 40 of the diffuser member 20.

The lower plate 24 includes a downstream shoulder 42 that is supportingly received by the outer annular surface 44 of a rigid support ring 46. A support shoulder 48 on the upstream end of the upper plate 26 likewise is in engagement with the ring 46 at the outer surface 44 thereof to center an upstream extending annular lip 50 at the outlet of the inlet diffuser member 20 and to locate it in a radially spaced relationship with the ring 46 to direct coolant flow against the upstream end of a dome 52 of the combustor assembly 22.

The dome 52, more particularly, is made up of a first contoured ring 54 of porous laminated material that includes a radially inwardly located edge portion 56 thereon secured by an annular weld 58 to a radially outwardly directed flange 60 on the ring 46. Downstream edge 62 of ring 54 is connected by an annular weld 64 to a radially outwardly convergent contoured ring portion 66 of dome 52 also of porous laminated material. The contoured ring 66 has its downstream edge 68 connected by an annular weld 70 to a porous laminated sleeve 72 which is connected by means of an annular weld to a flow transition member (not shown) of the combustor assembly 22.

In accordance with certain principles of the present invention, the inlet diffuser member 20 serves the dual purpose of defining a fixed support to locate the longitudinal axis of the combustor assembly 22 in parallel relationship to like canister combustor assemblies located at circumferentially spaced points within an annular exhaust duct 74 formed between an outer engine case 76 and an inner engine wall 78. To accomplish this purpose, the inlet diffuser member 20 includes a flow divider 80 with a leading edge 82 and a support rib 84 with spaced lands 86, 88 thereon with tapped holes 90, 92 formed therein to receive screws 94, 96 directed through the engine wall 16 to fixedly secure the inlet diffuser member 20 in place. Shoulders 44, 48 thereby are positioned axially of the ring 46.

Ring 46 also forms a housing for an air blast and fuel atomizer assembly 98 that directs air and fuel into a combustion chamber 100 within the porous laminated sleeve 72 in accordance with certain principles of the present invention as will be discussed.

Axial location of the combustor assembly 22 is established by means of a pin 102 held by a plug 104 secured by suitable means to the wall 16. The pin 102 is located in interlocking relationship with a slot 106 of predetermined arcuate extent within an embossment 108 secured to the combustor assembly 22 as best shown in FIG. 1.

In accordance with the present invention, the air blast and fuel atomizer assembly 98 is configured to be directed through a small diameter access opening 112 formed in a mounting pad 114 on the wall 16 that is in vertical alignment with an opening 116 in the upper plate 26 of the inlet diffuser member 20. In accordance with certain principles of the present invention, the fuel injector 134 can be removably replaced from the remainder of the combustor assembly 22 by removal of a single locator ring. Moreover, the connection of the assembly 98 to the combustor 22 is accomplished by an arrangement that permits parts of the assembly 98 to freely axially shift with respect to the combustor 22 to compensate for changes in the operating temperature in the domed end 52 thereof throughout different phases of gas turbine engine operation.

More particularly, the asssembly 98 includes an outer annular shroud 118 having a radially outwardly directed flange 120 thereon that is supportingly received within an undercut shoulder 122 on the inner periphery of the ring 46. The shroud 118 is axially fixedly secured with respect to the single structural support ring 46 by means of a locator ring 124 that is held in place against circumferential movement with respect to the ring 46 by means of an index pin 126 directed through both the locator ring 124 and an inboard flange 128 on the ring 46. Furthermore, the outer shroud 118 is fixed against rotation with respect to the ring 46 by means of an index pin 130 that has one end thereof directed into the locator ring 124 and the opposite end thereof located within a slot 132 on the flange 120 of the outer shroud 118. The undercut shoulder 122 on the ring 46 has a radial depth greater than that of the flange 120 and the slot 132 has a greater extent than the pin 130 whereby the shroud ring 118 is free to float radially with respect to the dome 52 during gas turbine engine operation.

Accordingly, the aforesaid support configuration defines a floating reference on the assembly 98 which will center a fuel injector nozzle 134 thereof with respect to a mixing chamber 136 formed within the dome 52.

Figure 2:
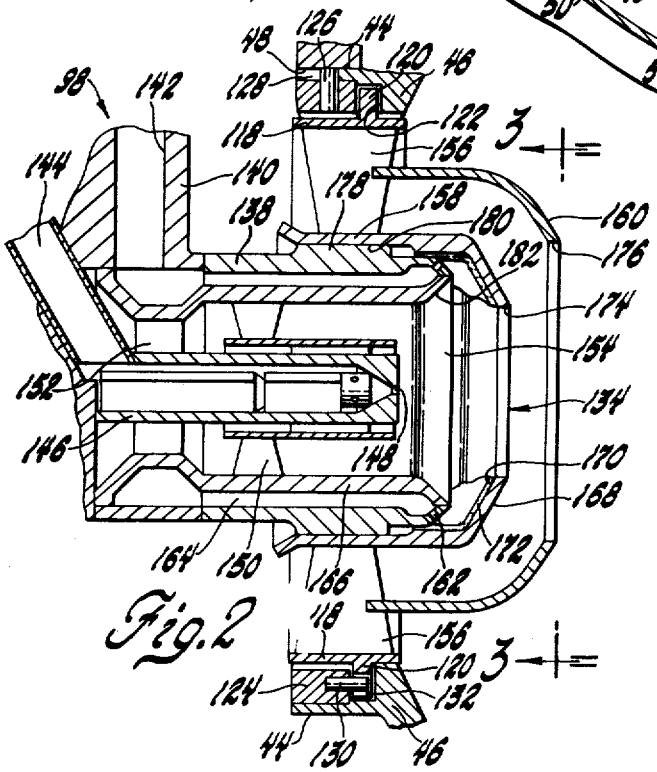
FIG. 2 is a fragmentary, enlarged cross-sectional view of a replaceable, combustion air swirler and fuel injector of the present invention.
Figure 3:
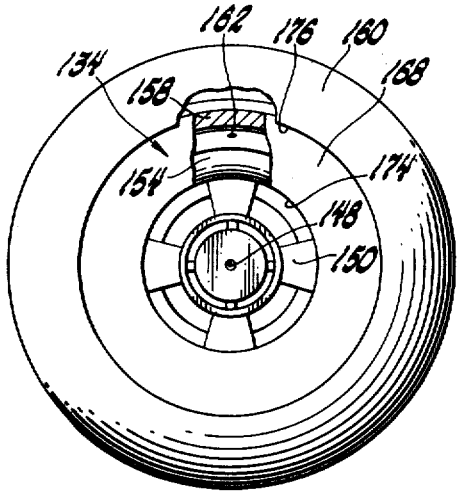
FIG. 3 is an end elevational view taken along the line 3—3 of FIG. 2 looking in the direction of the arrows.

In accordance with certain principles of the present invention and as best seen in FIGS. 2 and 3, the nozzle 134 is configured to assure thorough air blast atomization of air and fuel. More particularly, to accomplish this purpose, the nozzle 134 includes an annular housing 138 thereon that is connected to a stem portion 140 of the assembly 98 including a main fuel flow passage 142 therethrough. Additionally, the nozzle 134 includes a pilot fuel supply tube 144 that directs fuel into an internally located pilot nozzle 146 having an orifice 148 at the outlet end thereof for directing pilot fuel from the assembly into the chamber 136.

The pilot fuel is mixed with air flow from a plurality of circumferentially located internal swirler blades 150 that receive air from an inlet opening 152 and to discharge the air through an outlet opening 154.

The assembly 98 is structured to assure the controlled mixing of main fuel flow and an air blast flow during changes in the engine operating temperature. More particularly, to accomplish this purpose, the assembly 98 includes a plurality of vanes 156 directed radially between the outer shroud 118 and an inner ring 158 of the swirler and inclined to the longitudinal axis of nozzle 134. The vanes 156 are angled with respect to the longitudinal axis of the combustor 22 to produce a swirling action and air flow from the passage 36 into the mixing chamber 136. An intermediate, annular guide ring or air flow director lip 160 directs the swirled air directly radially inwardly downstream of vanes 156 for mixing with fuel from a plurality of main fuel ports 162 in housing 138 which, with parts to be described, form a tangential fuel director outwardly of an annular fuel passage 164 in nozzle 134 that is in communication with the passage 142 and formed between the housing 138 and an annular interior wall 166 that forms the outer surface of the air passage from the air swirler 150 in surrounding relationship to the pilot nozzle 146.

The inner ring 158 includes a radially inwardly directed fuel atomization lip 168 that is located in overlying, axially spaced, downstream relationship with the ports 162 forming the tangential fuel director of the assembly. The lip 168 includes an inner surface 170 thereon against which the main fuel flows to an annular outlet edge 174 on the fuel atomization lip 168. The outer annular air flow directing lip 160 also has an outlet edge 176 thereon that is maintained in a continually fixed axially spaced relationship with respect to the edge 174 throughout changes in the temperature of the dome 52 of the combustor 22. The floating swirler vanes 156 are held by the locator ring 124 against axial movement with respect to the combustor dome 52. However, the housing 138 includes a radial rib 178 thereon that is slidably supported within the inner surface 180 of the inner ring 158 to permit free axial movement of the annular housing 138 of the fuel nozzle 134 with respect to the dome 52 produced by differences in the operating temperatures thereof. It should be noted that as the annular housing 138 and the tangential fuel director ports 162 of fuel nozzle 134 move axially with respect to the swirler ring 158, the fuel ports 162 will continue to lay down a film of fuel 172 that will be maintained uniformly across the edge 174 throughout axially shifted positions of the director ports 162 nozzle 134 with respect to the ring 158 of the swirler. Since the edges 174, 176 are maintained at a constantly fixed dimensional relationship therebetween throughout such axially shifted positions of the nozzle 134, the fuel breakup point for atomization of main fuel and air remains the same during all phases of gas turbine engine operation.

The aforesaid arrangement enables the nozzle 134 and swirler vanes 156 to be separately connected to the combustor and removably replaced without cutting or welding component parts of the swirler. The swirler and nozzle form a complete air blast system that is configured to maintain full air flow volumes throughout different ranges of gas turbine engine operation. More specifically, as viewed in FIG. 2, the pilot fuel swirler 150 is in communication with a radially outwardly flared large diameter air opening 182. Moreover, the swirler vanes 156 will receive unrestricted flow of combustion air from the passage 36 and will direct part of it by the air director lip 160 into direct atomizing relationship with the main fuel film 172 and the remainder into the mixing chamber 136.

The above described air blast fuel supply arrangement enables a single support member in the form of ring 46 to serve as a support for both the front end of a combustion liner and as a support for the swirler. Moreover, the floating swirler construction allows the vanes 156 to remain concentric while the fuel nozzle 138 and combustor dome 52 are independently supported by the specially configured inlet diffuser member 20 and the associated air flow divider 80 thereon.

Another advantage of the present invention is that it enables the liner or dome rings 54, 66 and sleeve 72 to be fabricated from a porous laminated material to affect transpiration cooling of the inner walls during gas turbine engine operation and to do so while minimizing the quantities of wall cooling air flow into the interior of the combustor 22. The arrangement cools the inside surface of the combustor 22 where it is exposed to the flame front within a combustion chamber 100 downstream of the mixing chamber 136. In the illustrated arrangement, the porous laminated material of the dome 52 and the sleeve 72 includes a plurality of separate sheets having an air flow pattern therein of the type set forth in U.S. Pat. No. 3,584,972, issued June 15, 1971, to Bratkovich et al. In the illustrated arrangement, the flow pattern includes pores and grooves with a configuration such that the combustor liner has a discharge coefficient of 0.006 per square inch of liner wall area. Combustion air distribution into the assembly 22 includes 11.5% total combustion air flow through the assembly 98. A front row of primary air holes 186 in the combustor 22 receives 14.5% of the combustion air flow. Subsequent intermediate holes and dilution holes (not shown) direct the remainder of the air flow into the combustor 22 along with the air flow which passes through the laminated walls of the combustor 22.

While the embodiments of the present invention, as herein disclosed, constitute a preferred form, it is to be understood that other forms might be adopted.

The embodiments of the invention in which an exclusive property or privilege is claimed are defined as follows:

1. An air blast fuel supply system for directing air and fuel into a combustor having a fixed dome thereon comprising: a floating swirler and fuel injector nozzle, means for radially supporting both said swirler and fuel injector nozzle for free radial movement and axial restraint with respect to said dome, means for defining a tangential fuel director movably supported for axial movement on said fuel injector nozzle, a fuel atomization lip fixed on said floating swirler and located in spaced overlying relationship to said tangential fuel director to form an annular fuel film at the outlet of said fuel injector nozzle, means including an annular air flow directing lip fixed on said floating swirler to direct inlet air flow against the fuel film to atomize it as it leaves said atomization lip, said tangential fuel director and fuel atomization lip maintaining said annular fuel film throughout axially shifted positions of said tangential fuel director with respect to said fuel atomization lip, said fuel atomization lip having an outlet edge thereon and said outer air flow directing lip having an outlet edge thereon maintained at a constantly fixed dimensional relationship therebetween throughout axial shifted movements of said tangential fuel director whereby the fuel break-up point for atomization of fuel and air from said fuel nozzle remains the same with respect to the combustor during engine operation.

2. An air blast fuel supply system for directing air and fuel into a combustor having a fixed dome thereon comprising: a floating swirler and fuel injector nozzle, means for radially supporting both said swirler and fuel injector nozzle for free radial movement with respect to said dome, said last mentioned means including a dome support ring with a recessed radial shoulder, said swirler having a shroud with a radial flange slidably supported by said shoulder and a removable locator ring secured to said support ring for removably axially retaining said swirler in place, means for defining a tangential fuel director movably supported for axial movement on said fuel injector nozzle, a fuel atomization lip fixed on said floating swirler and located in spaced overlying relationship to said tangential fuel director to form an annular fuel film at the outlet of said fuel injector nozzle, means including an annular air flow directing lip fixed on said floating swirler to direct inlet air flow against the fuel film to atomize it as it leaves said atomization lip, said tangential fuel director and fuel atomization lip maintaining said annular fuel film throughout axially shifted positions of said tangential fuel director with respect to said fuel atomization lip, said fuel atomization lip having an outlet edge thereon and said outer air flow directing lip having an outlet edge thereon maintained at a constantly fixed dimensional relationship therebetween throughout axial shifting movement of said tangential fuel director whereby the fuel break-up point for atomization of fuel and air from said fuel nozzle remains the same with respect to the combustor during engine operation.

* * * * *